US006775495B2

(12) United States Patent
Kida

(10) Patent No.: US 6,775,495 B2
(45) Date of Patent: Aug. 10, 2004

(54) IMAGE FORMING APPARATUS

(75) Inventor: Hiroshi Kida, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/459,277

(22) Filed: Jun. 11, 2003

(65) Prior Publication Data

US 2003/0206750 A1 Nov. 6, 2003

Related U.S. Application Data

(62) Division of application No. 09/997,365, filed on Nov. 30, 2001, now Pat. No. 6,600,885.

(30) Foreign Application Priority Data

Feb. 1, 2001 (JP) ..... 2001-026157

(51) Int. Cl.[7] ..... G03G 15/00
(52) U.S. Cl. ..... 399/124
(58) Field of Search ..... 399/124, 110, 399/107

(56) References Cited

U.S. PATENT DOCUMENTS 5,418,606 A 5/1995 Kikuchi et al.
5,802,426 A 9/1998 Miyazaki et al.
6,134,404 A * 10/2000 Iwai et al. ..... 399/110
6,145,828 A 11/2000 Arai
6,215,970 B1 4/2001 Yoshikawa et al.

FOREIGN PATENT DOCUMENTS

JP 8-18724 4/1989

OTHER PUBLICATIONS

Sibling Divisional Applications entitled "Image Forming Apparatus", filed Jun. 11, 2003, (claims attached).

* cited by examiner

*Primary Examiner*—Quana Grainger
(74) *Attorney, Agent, or Firm*—Renner, Otto, Boisselle & Sklar, LLP

(57) ABSTRACT

A main body is separable into a static body and a movable body along a carrier path extending from a sheet feeding unit to a sheet discharge unit, and the static body is provided with an image forming unit. The movable body can be slid straightly with respect to the static body. The carrier path can be wide open along the entire length thereof by sliding the movable body, facilitating the removal of stuck sheet from the carrier path.

1 Claim, 11 Drawing Sheets

IMAGE FORMING APPARATUS

This application is a divisional of copending U.S. Ser. No. 09/997,365, filed Nov. 30, 2001 now U.S. Pat. No. 6,600,885.

BACKGROUND OF THE INVENTION

The present invention relates to an image forming apparatus adapted to enable a sheet or the like stuck in a carrier path to be removed by opening the carrier path between a feeding unit for feeding such a sheet to an image forming unit and a discharge unit for discharging the sheet carried from the image forming unit to the outside.

Digital technology has recently found its fields of application in copying machines, and attempts are being made to improve image quality through the use of laser recording. The digital copying machines are now capable of producing an image output from data transmitted from devices other than a scanner unit in a copying machine, such as a personal computer and a facsimile machine, connected through an interface.

A need arises here to produce image outputs in the same order as the associated image data inputs are received from another device or apparatus. "Face-down" types are currently popular; those types discharge sheet sequentially from the discharge unit so that the side of the sheet on which an image is formed looks down.

The face-down type is equipped with a carrier path through which, sheet is fed sheet by sheet from a feeding unit, such as a sheet feeding unit, situated below an image forming unit and also sheet, after an image is formed thereon, is discharged face-down from a discharge unit situated above the image forming unit. Along the carrier path extending upright between the feeding unit and the discharge unit are there provided a pair of carrier rollers, transfer device, peeler device, fixing device, and other devices, which overall complicates the structure of the apparatus. Miniaturization of the image forming apparatus is another trend recently being pursued; if moving sheet gets stuck in the carrier path as a result of a problem in the image forming apparatus, removing the stuck sheet is a troublesome task.

Japanese Patent Publication No. 8-18724 discloses an image forming apparatus having a main body which is separable into two parts with respect to the carrier path extending upright between the feeding unit and the discharge unit, one of the parts being a static body including an image forming unit, the other part being a movable body which, near the bottom thereof, is engaged rotatably to the static body via a supporting axis and which can thereby swing with respect to the static body, wherein if moving sheet gets stuck in the carrier path, the carrier path can be opened by swinging the movable body around the supporting axis, allowing the sheet to be removed from the carrier path.

In the conventional image forming apparatus, the movable body in the main body is engaged rotatably with the static body, and the movable body is swung around the supporting axis. The structure allows the carrier path to be wide open on the side opposite to the swing center, but not on the side of the swing center. Therefore, it is difficult to remove sheet stuck near the entrance of the carrier path (near the feeding unit).

Further, the entire movable body swings around the supporting axis, tracing an arc; therefore the transfer device, the carrier rollers, and other components which forms the carrier path in the movable body move tracing a curve, rather than a straight line. This makes it difficult to accurately position the aforementioned components of the carrier path mounted to the movable body and the image forming unit and the components of the carrier path, such as the carrier rollers and the fixing device, mounted to the static body. The movable body swings especially violently on the side far from the swing center, in other words, the exit of the carrier path, tracing a large arc, and requires high accuracy in relative positioning with respect to the static body. If accurate positioning of the components of the carrier path fails, problems are likely to develop with moving sheet in the carrier path.

Besides, when the movable body is swung around the supporting axis, the movable body experiences a relatively large impact. Possible impact could be taken care of, by providing strength compensation to the supporting axis and associated parts and impact alleviation by means of a hydraulic dumper or another mechanism. However, this will add to the total weight of the image forming apparatus and result in increased load in swinging the movable body, which undesirably degrades operability of the movable body.

To make the entrance of the carrier path (a part near the feeding unit) wide open, the supporting axis and the static body need be separated by a relatively great distance. This however adds to the size of the image forming apparatus and requires increased room for installation including free space to swing the movable body. It therefore becomes difficult to install the apparatus in limited space. If the movable body is provided with a switchback carrier path and a cover body which can swing so as to open the switchback carrier path, the movable body is swung first, and the cover body needs be also swung with respect to the already swung movable body, which adds to difficulty to the removing of sheet.

BRIEF SUMMARY OF THE INVENTION

An object of the invention is to provide an image forming apparatus having a carrier path which can be wide open along the entire length thereof without adding to the size owing to such a configuration that enables a movable body in a main body to slide and optionally a sub-carrier path, being connected to the carrier path at the midpoint thereof, which can be wide open together with the carrier path.

Another object of the invention is to provide an image forming apparatus that can maintain good positional relationship among components forming a carrier path between a static body and a movable body in a main body and also that can position, relative to the image forming unit, an auxiliary device, such as a transfer device, mounted to the movable body with increased accuracy when the movable body is slid closed, owing to a configuration in which the static body or the movable body has a guide member for guiding the slide movement of the movable body.

A further object of the invention is to provide an image forming apparatus which satisfactorily prevents a sheet stuck in the carrier path from falling when the carrier path is opened, owing to a configuration in which either the static body or the movable body has a pair of carrier rollers carrying the sheet.

Yet another object of the invention is to provide an image forming apparatus that can position the auxiliary device, such as the transfer device, relatively to the image forming unit with increased accuracy when the movable body is slid closed, owing to a configuration in which the auxiliary device is provided swingingly to the movable body.

An image forming apparatus in accordance with a first aspect includes: an image forming unit for forming an image on a sheet; a feeding unit for feeding the sheet toward the image forming unit; a discharge unit for discharging the sheet carried from the image forming unit to the outside thereof; and a main body separable into a static body and a movable body along a carrier path extending from the feeding unit to the discharge unit, the static body being provided with the image forming unit, and is adapted so that the movable body is sidable with respect to the static body.

According to the first aspect, the carrier path extending from the feeding unit to the discharge unit can be wide open along the entire length thereof by sliding open the movable body; therefore, sheet stuck in the carrier path, especially, in winding and other parts where sheet is likely to get stuck, can be readily spotted and easily removed. The image forming apparatus thus delivers good operability in sheet removal. The movable body slides and experiences a relatively small impact when slid open; therefore, the movable body no longer needs a complicated supporting mechanism. The image forming apparatus weighs less and requires less installation space.

An image forming apparatus in accordance with a second aspect is such that the feeding unit is provided in plurality and that the main body is separable into the static body and the movable body along the carrier path extending from the plurality of feeding units to the discharge unit.

An image forming apparatus in accordance with a third aspect is such that the carrier path of one of the plurality of feeding units which is located relatively near the image forming unit is connected to the carrier path formed by one of the plurality of feeding units which is located relatively far from the image forming unit.

According to the second and third aspects, the carrier path extending from the plurality of feeding units to the discharge unit can be wide open along the entire length thereof by sliding open the movable body; therefore, sheet stuck near any feeding unit can be easily removed. The image forming apparatus thus delivers good operability in sheet removal.

An image forming apparatus in accordance with a fourth aspect is such that the movable body has guide units for guiding the sheet on which an image is formed by the image forming unit along the carrier path.

According to the fourth aspect, when the movable body is slid closed, the carrier path extending from the image forming unit to the discharge unit can be positioned to a predetermined state by means of a simple configuration; therefore, problems are less likely to occur at junctions of the static body and the movable body in the carrier path.

An image forming apparatus in accordance with a fifth aspect includes: an image forming unit for forming an image on a sheet; a feeding unit, provided below the image forming unit, for feeding the sheet toward the image forming unit; a discharge unit, provided above the image forming unit, for discharging the sheet carried from the image forming unit to the outside; a carrier path extending from the feeding unit to the discharge unit; a sub-carrier path, being connected to the carrier path near an exit thereof, for carrying the sheet carried from the image forming unit in a direction moving away from the discharge unit; and a main body separable into a static body and a movable body along the carrier path, the static body being provided with the image forming unit, and is adapted so that the sub-carrier path extends flatly sideways and that the movable body is sidable with respect to the static body along the sub-carrier path.

With the fifth aspect, all the advantages of the first aspect are available. Further, the sub-carrier path can be wide open, and sheet stuck in the sub-carrier path can be easily removed.

An image forming apparatus in accordance with a sixth aspect is such that the sub-carrier path is shorter than the carrier path.

According to the sixth aspect, the carrier path and the sub-carrier path can be wide open along the entire lengths thereof by sliding the movable body a distance, $L+\alpha$, which is equal to a sum of the length L of the sub-carrier path and a suitable distance $\alpha$. Therefore, the movable body needs to be slid a shorter distance, requiring less space to install the image forming apparatus.

An image forming apparatus in accordance with a seventh aspect is such that the sub-carrier path, near an entrance thereof, overlaps the carrier path and from the entrance to an exit thereof, extends flatly in a direction moving away from the discharge unit and that the movable body is slidable along the sub-carrier path.

According to the seventh aspect, the sub-carrier path extending flatly in a direction moving away from the discharge unit, near an entrance thereof, overlaps the carrier path; therefore, the movable body needs to be slid an even shorter distance, requiring even less space to install the image forming apparatus.

An image forming apparatus in accordance with an eighth aspect is such that the sub-carrier path is an entrance of a switchback carrier path for carrying the sheet carried from the image forming unit to an entrance of the carrier path.

According to the eighth aspect, the switchback carrier path can be wide open near the entrance thereof, that is, the exit of the carrier path, which is the most difficult part to carry sheet in the carrier path; therefore, sheet stuck in the carrier path can be readily spotted and easily removed.

An image forming apparatus in accordance with a ninth aspect includes a pair of carrier rollers, mounted to either the static body or the movable body, for carrying the sheet along the carrier path while holding the sheet in between at a position facing the carrier path.

According to the ninth aspect, when the movable body is slid open to open the carrier path, the pair of carrier rollers mounted to the movable body continue holding the sheet in between. Those areas surrounding the carrier path and the user's hands can be thereby prevented from being smeared with an unfixed toner image on sheet which droops or falls from the carrier path. The sheet stuck in the carrier path can be readily spotted. The image forming apparatus thus again delivers good operability in sheet removal.

An image forming apparatus in accordance with a tenth aspect is such that the static body includes: a control roller for controlling a timing to carry the sheet to the image forming unit; and a guide body for guiding the sheet to the control roller, the control roller and the guide body both being provided between the feeding unit and the image forming unit at a position facing the carrier path.

According to the tenth aspect, even if the carrier path is opened, the control roller for controlling a timing to carry the sheet to the image forming unit is positioned unchanged with respect to the guide body for guiding the sheet to the control roller, for better resist precision. The image is therefore formed on the sheet at an ideal position.

An image forming apparatus in accordance with an eleventh aspect includes: an image forming unit for forming an image on a sheet; a feeding unit for feeding the sheet toward the image forming unit; a discharge unit for discharging the sheet carried from the image forming unit to the outside; a sub-carrier path, being connected to an exit side of a carrier path between the feeding unit and the discharge unit, for carrying the sheet having passed through the image forming unit in a direction different from the discharge unit; and a main body separable into a static body and a movable body along the carrier path, the static body being provided with the image forming unit, and is adapted so that the movable body is slidable with respect to the static body and has a guide unit for guiding the sheet along the sub-carrier path.

With the eleventh aspect, all the advantages of the first aspect are available. Further, the sheet in the carrier path can be carried to the sub-carrier path along the guide unit of the movable body; therefore, by sliding open the movable body, the sub-carrier path can be wide open, facilitating the removal of sheet stuck in the sub-carrier path.

An image forming apparatus in accordance with a twelfth aspect includes: an image forming unit for forming an image on a sheet; a feeding unit for feeding the sheet toward the image forming unit; a discharge unit for discharging the sheet carried from the image forming unit to the outside; a switchback carrier path, being connected to an entrance side and an exit side of a carrier path between the feeding unit and the discharge unit, for carrying the sheet carried from the image forming unit toward the feeding unit; and a main body separable into a static body and a movable body along the carrier path, the static body being provided with the image forming unit, and is adapted so that the feeding unit is provided in plurality and that the movable body has a guide unit, provided below a connection portion where the switchback carrier path is connected to the exit side of the carrier path, for guiding along the carrier path the sheet carried from one of the plurality of feeding units which is located relatively far from the image forming unit to the carrier path formed by one of the plurality of feeding units which is located relatively near the image forming unit.

With the twelfth aspect, all the advantages of the first aspect are available. Further, when the movable body is slid closed, the carrier path connected to the plurality of feeding units can be positioned to a predetermined state by means of a simple configuration; therefore, problems are less likely to occur at junctions of the static body and the movable body in the carrier path.

An image forming apparatus in accordance with a thirteenth aspect is such that the movable body has a guide unit for guiding along the carrier path the sheet carried from the switchback carrier path to the carrier path.

According to the thirteenth aspect, when the movable body is slid closed, a part of the carrier path which is connected to the switching carrier path near the exit thereof can be positioned to a predetermined state by means of a simple configuration; therefore, problems are less likely to occur at junctions of the static body and the movable body in the carrier path.

An image forming apparatus in accordance with a fourteenth aspect includes: a carrier switching body for carrying the sheet carried from the image forming unit by switching between the discharge unit and the sub-carrier path; and a holding body, mounted swingingly to the movable body, for holding the carrier switching body.

According to the fourteenth aspect, the holding body for holding the carrier switching body is mounted swingingly to the movable body; therefore, when the movable body is slid closed, the carrier switching body can be accurately positioned with respect to the carrier path and the sub-carrier path, thereby improving the quality of the image output produced on the sheet. The sheet can be carried in a satisfactory manner in the sub-carrier path in which eet passes after the fixing and tends to be carried only in an unstable manner.

An image forming apparatus in accordance with a fifteenth aspect is such that either the static body or the movable body has multiple guide members for guiding the slide movement of the movable body, and the movable body has an auxiliary device, located among the guide members, for assisting image formation on the sheet in the image forming unit.

According to the fifteenth aspect, the auxiliary device, for example, a transfer device, is mounted to the movable body, among the guide members. Therefore, when the movable body is slid closed, the auxiliary device can be moved toward the image forming unit, while keeping a substantially correct positional relationship. The auxiliary device can thereby be accurately positioned with respect to the image forming unit, which improves the quality of the image formed on the sheet.

An image forming apparatus in accordance with a sixteenth aspect is such that the guide members are disposed on both sides of the carrier path in terms of width thereof and on an entrance side and an exit side of the carrier path.

According to the sixteenth aspect, the auxiliary device is mounted to the movable body in an area formed by the guide members disposed in the back and those disposed in the front as viewed with the image forming apparatus installed in a suitable place; therefore, when the movable body is slid closed, the auxiliary device can be moved straightly toward the image forming unit in a stable condition. The auxiliary device can be thereby accurately positioned with respect to the image forming unit, improving the quality of the image formed on the sheet.

An image forming apparatus in accordance with a seventeenth aspect is such that the auxiliary device is disposed at the central position among the guide members.

According to the seventeenth aspect, the auxiliary device is mounted to the movable body substantially at the center of an area formed by the multiple guide members; therefore, when the movable body is slid closed, the auxiliary device can be moved straightly toward the image forming unit in a stable condition. The auxiliary device can be thereby accurately positioned with respect to the image forming unit, improving the quality of the image formed on the sheet.

An image forming apparatus in accordance with an eighteenth aspect is such that either the static body or the movable body has: a guide member for guiding the slide movement of the movable body; and prevention means for preventing the slide movement of the movable body, and there is provided an auxiliary device, located between the guide member and the prevention means, for assisting image formation on the sheet in the image forming unit.

According to the eighteenth aspect, the auxiliary device is mounted to the movable body between the guide member and the prevention means; therefore, when the movable body is slid closed, the auxiliary device can be moved straightly toward the image forming unit in a stable condition, and the movable body can be surely kept closed. The auxiliary device can be thereby accurately positioned with respect to the image forming unit, and the relative position is surely maintained, improving the quality of the image formed on the sheet.

An image forming apparatus in accordance with a nineteenth aspect is such that either the static body or the movable body has guide members, located near an entrance and exit of the carrier path, for guiding the slide movement of the movable body, and there are provided among the guide members: an auxiliary device for assisting image formation on the sheet in the image forming unit; and prevention means for preventing the slide movement of the movable body.

According to the nineteenth aspect, the guide members are disposed near the top and an bottom of the main body, and sheet stuck in the carrier path can be readily removed, with none of the guide members obstructing the removing action. Besides, the auxiliary device and the prevention means are disposed among the guide members for sliding the movable body; therefore, when the movable body is slid closed, the auxiliary device can be moved straightly toward the image forming unit, while keeping a substantially correct positional relationship. The auxiliary device can thereby be accurately positioned with respect to the image forming unit. In addition, the movable body can be slid smoothly and experiences less deformation in the slide movement; as a result, the movable body can be slid straightly.

An image forming apparatus in accordance with a twentieth aspect includes: guide members, disposed on both sides of the carrier path in terms of width thereof, for guiding the slide movement of the movable body; and an auxiliary device, located near the guide members, for assisting image formation on the sheet in the image forming unit.

According to the twentieth aspect, the auxiliary device is located among the guide members disposed on both sides of the carrier path in terms of width thereof, therefore, when the movable body is slid closed, the auxiliary device can be moved straightly toward the image forming unit, while keeping a substantially correct positional relationship. The auxiliary device can thereby be accurately positioned with respect to the image forming unit, improving the quality of the image formed on the sheet.

An image forming apparatus in accordance with a twenty-first aspect is such that there are more guide members on one side of the carrier path in terms of width thereof than on the other side.

According to the twenty-first aspect, there can be less guide members in the front than in the back as viewed with the image forming apparatus installed in a suitable place; therefore, sheet stuck in the carrier path can be readily spotted. Moreover, the guide members present less obstruction to sheet removing action. The image forming apparatus thus delivers good operability in sheet removal.

An image forming apparatus in accordance with a twenty-second aspect is such that one side of the auxiliary device is supported between the guide members on one side and the other side thereof is supported near the guide members on the other side.

According to the twenty-second aspect, the auxiliary device is mounted to the movable body with one of sides of the auxiliary device located near the guide members on the other side and with the other side located between the guide members on the one side; therefore, when the movable body is slid closed, the auxiliary device can be moved straightly toward the image forming unit, while keeping a substantially correct positional relationship. The auxiliary device can thereby be accurately positioned with respect to the image forming unit, improving the quality of the image formed on the sheet.

An image forming apparatus in accordance with a twenty-third aspect is such that the auxiliary device is a transfer device of a contact type which contacts the image forming unit, and the transfer device is disposed near the prevention means.

According to the twenty-third aspect, a good positional relationship is always ensured between the sheet and the transfer device, and the prevention means reduces variations in the relationship between the sheet and the rotated transfer device to a minimum. The transfer device can thereby be accurately positioned with respect to the image forming unit, improving the quality of the image formed on the sheet.

An image forming apparatus in accordance with a twenty-fourth aspect is such that the guide members on the other side of the carrier path in terms width thereof are located far from a contact portion where a side of the sheet contacts in the carrier path.

An image forming apparatus in accordance with a twenty-fifth aspect is such that the contact portion is a winding part, a connection portion where the sub-carrier path is connected, or a connection portion where a switchback carrier path is connected.

According to the twenty-forth or twenty-fifth aspect, those guide members in the front as viewed with the image forming apparatus installed in a suitable place can be disposed a distance away from parts of a carrier path where problems are likely to develop with moving sheet. The guide members therefore present less obstruction in removing sheet stuck in the carrier path. The image forming apparatus thus delivers improved operability in sheet removal.

An image forming apparatus in accordance with a twenty-sixth aspect is such that the auxiliary device is disposed swingingly.

According to the twenty-sixth aspect, the auxiliary device is mounted swingingly to the movably body; therefore, when the movable body is slid closed, the auxiliary device can thereby be accurately positioned with respect to the surface of the image forming unit, improving the quality of the image formed on the sheet. Further, since the auxiliary device can thereby be accurately positioned with respect to the surface of the image forming unit, no highly precise sliding means is required to slide the movable body. Costs are saved and the movable body can be slid smoothly.

An image forming apparatus in accordance with a twenty-seventh aspect is such that the auxiliary device is a transfer device for transferring the image formed by the image forming unit onto the sheet.

According to the twenty-seventh aspect, when the movable body, which is slidable by the benefit of the guide members, is slid closed, the transfer device can be positioned with respect to the image forming unit mounted to the static body in a suitable condition. Thus, the quality of the image formed on the sheet is ensured.

An image forming apparatus in accordance with a twenty-eighth aspect is such that the auxiliary device is a transfer device of a contact type which contacts the image forming unit.

According to the twenty-eighth aspect, the transfer device of a contact type is mounted to the movable body which is slidable; therefore, when the movable body is slid closed, the transfer device of a contact type can be positioned with respect to the image forming unit in a predetermined positional relationship, and the quality of the image formed on the sheet is improved.

An image forming apparatus in accordance with a twenty-ninth aspect is such that the transfer device has a connection terminal connected to and disconnected from a power source terminal provided to the static body.

According to the twenty-ninth aspect, the connection terminal is provided to the transfer device which can be accurately positioned with respect to the image forming unit; therefore, when the movable body is slid closed, the connection terminal provided to the transfer device can be surely connected to the power source terminal provided to the static body, which ensures image formation on the sheet.

Further, the connection terminal can be surely connected to the power source terminal; therefore, faulty operations due to damage or improper connection of the power source terminal and the connection terminal can be avoided.

The above and further objects and features of the invention will more fully be apparent from the following detailed description with accompanying drawings.

BRIEF DESCRIPTION OF THE SEVERAL VIEWS OF DRAWINGS

DETAILED DESCRIPTION OF THE INVENTION

The following will describe the invention in reference to drawings showing embodiments thereof.

Embodiment 1

Figure 1:
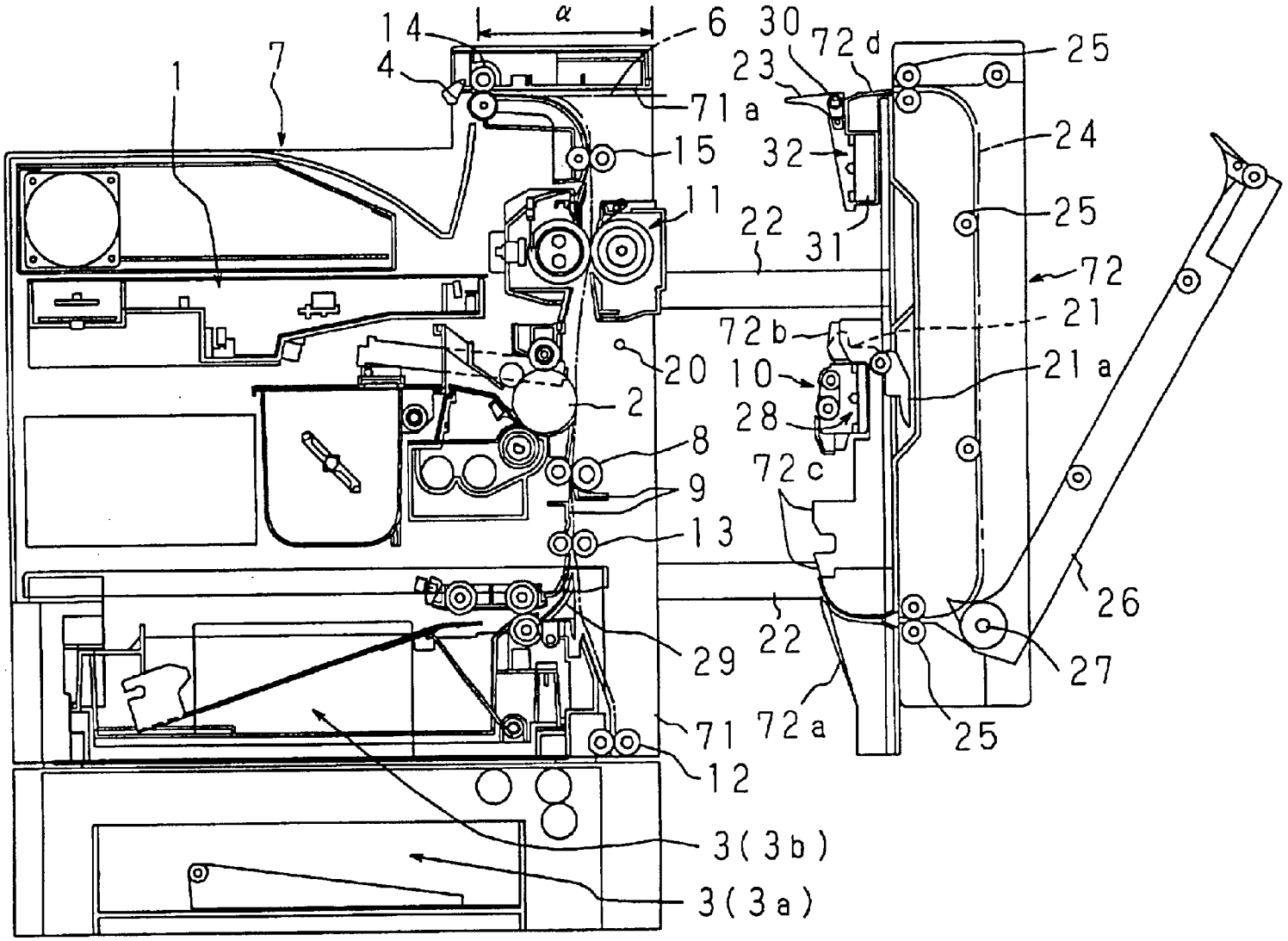
FIG. 1 is a cross-sectional view of an image forming apparatus in accordance with the invention, showing an open carrier path.
Figure 2:
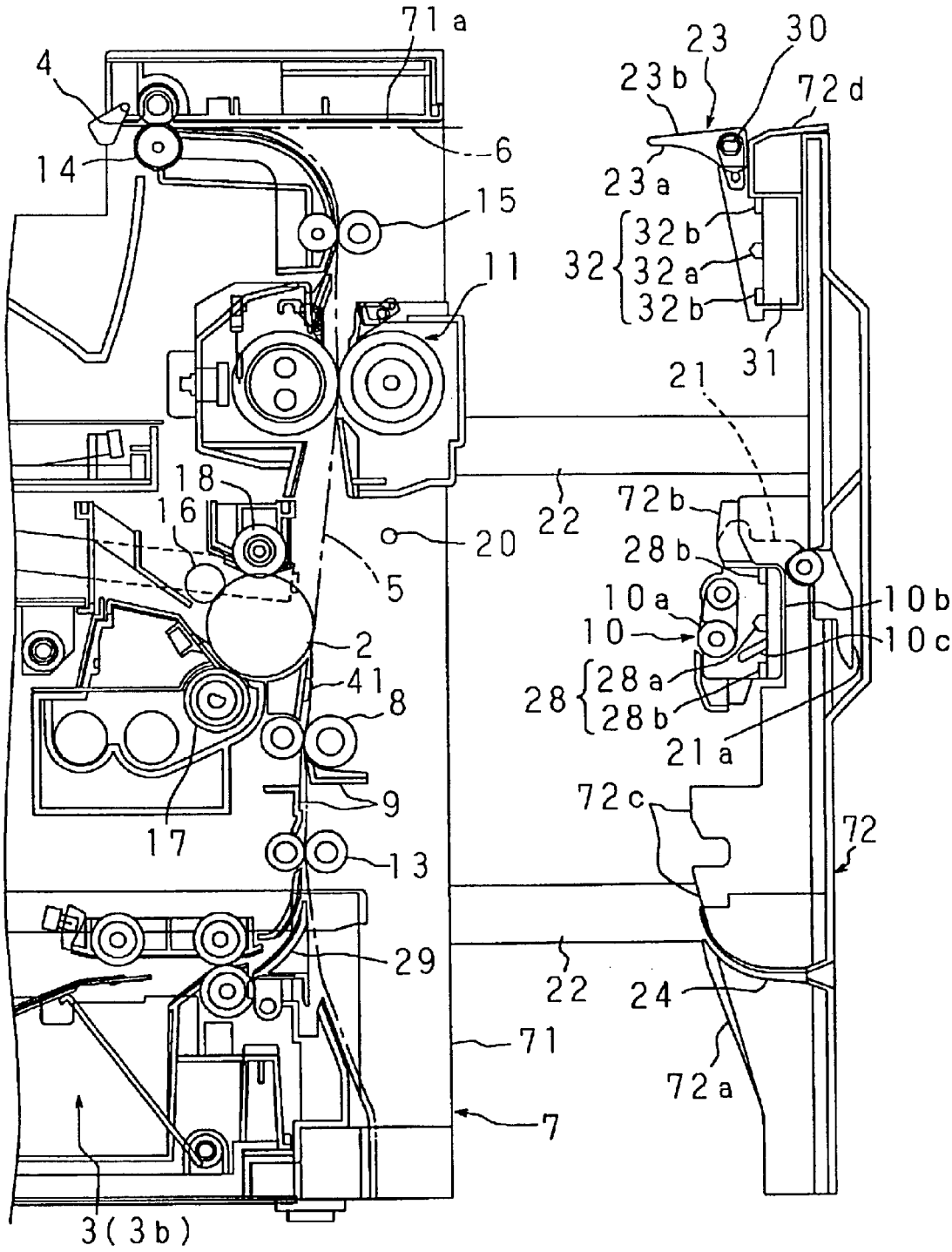
FIG. 2 is a cross-sectional view of major components of an image forming apparatus in accordance with the invention, showing an open carrier path.

FIG. 1 is a cross-sectional view of an image forming apparatus in accordance with the invention, showing an open carrier path; FIG. 2 is a cross-sectional view of major components of the image forming apparatus, showing an open carrier path; and FIG. 3 is a cross-sectional view of the image forming apparatus having a single feeding unit, showing a closed carrier path.

Figure 3:
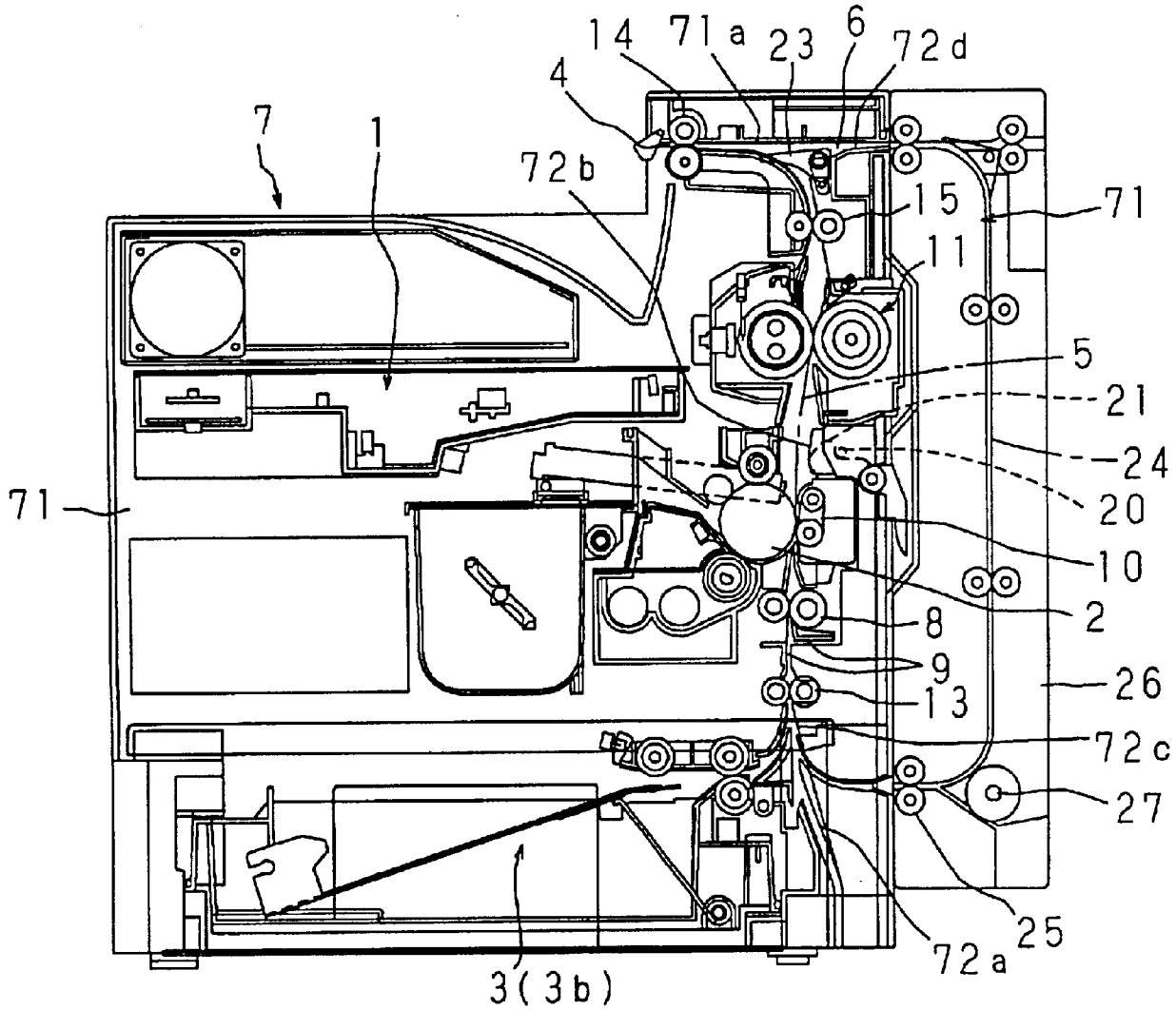
FIG. 3 is a cross-sectional view of an image forming apparatus having a single feeding unit in accordance with the invention, showing a closed carrier path.

The image forming apparatus, as shown in FIGS. 1–3, includes: an image forming unit 2, constructed of a drum-shaped photosensitive body which produces an image on a sheet, for forming on a surface of the sheet an original document image scanned by a scanner unit 1; multiple feeding units 3, located below the image forming unit 2, for feeding sheet from a cassette to the image forming unit 2; a discharge unit 4, located above the image forming unit 2, for discharging sheet carried from the image forming unit 2 to the outside; a carrier path 5, extending upright (in other words, substantially vertically) between the discharge unit 4 and a lower feeding unit 3*a* located relatively far from the image forming unit 2; a sub-carrier path 6, being connected to the carrier path 5 near the exit thereof, for carrying sheet carried from the image forming unit 2 in a direction opposite to the discharge unit 4; and a main body 7 separable into two parts with respect to the carrier path 5, one of the two parts being a static body 71 including the image forming unit 2, the other part being a movable body 72 which can slide with respect to the static body 71.

Facing the carrier path 5 are located a pair of control rollers 8 for controlling a timing to move the sheet carried from the feeding units 3 to the image forming unit 2 so as to carry the sheet to the image forming unit 2 at an accurate timing; a pair of plate-shaped guide bodies 9 for guiding the sheet to the control rollers 8; a transfer device 10 of a contact type for transferring to the sheet a toner image formed (developed) by the image forming unit 2 by way of contact with the image forming unit 2; and a fixing device 11 for fixing onto the sheet the toner image transferred onto the sheet by the transfer device 10. Facing the carrier path 5, pairs of carrier rollers 12, 13, 14, and 15 are provided, two pairs near the respective feeding units 3, another near the discharge unit 4, and the other between the fixing device 11 and the sub-carrier path 6. The transfer device 10 is a part of an auxiliary device for assisting image formation in the image forming unit 2.

Components provided around the image forming unit 2 include: a charging device 16 for electrically charging the image forming unit 2; a developing device 17 for developing an electrostatic latent image formed on the image forming unit 2; the transfer device 10; and a cleaning device 18 for collecting residual toner from the surface of the image forming unit 2. The cleaning device 18 is connected to a tank in the developing device 17 by toner collecting means, such as a carrier pipe, so that the toner removed by the cleaning device 18 can be collected in the tank in the developing device 17 for potential reuse.

The main body 7 is divided into the static body 71 and the movable body 72 by the carrier path 5 so that sheet stuck somewhere along the length of a carrier path can be removed. An arrangement is made so that by sliding open the movable body 72 in a direction substantially parallel to the static body 71, the carrier path 5 can be wide open, separated into two parts by a substantially equal distance along its entire length.

To the static body 71 are mounted the scanner unit 1, the image forming unit 2, the charging device 16, the developing device 17, the cleaning device 18, the fixing device 11, the control rollers 8, the guide bodies 9, the carrier rollers 12–15, etc. Below the static body 71 are there provided cassettes of the feeding units 3 so as to be retractable sideways. There is also an engagement portion 20, such as a pin, provided to the static body 71 near the image forming unit 2.

To the movable body 72 are mounted: prevention means engaging/disengaging with the engagement portion 20 and formed by a lock claw 21 for preventing the movable body 72 from sliding so as to keep the carrier path 5 closed; multiple guide members 22 each shaped like a narrow plate and extending toward the static body 71; the transfer device 10; a carrier switching body 23 for switching the carrier between the discharge unit 4 and the sub-carrier path 6 to carry the sheet carried from the image forming unit 2; a switchback carrier path 24 with the entrance thereof connected to the sub-carrier path 6 and the exit thereof connected near the entrance of the carrier path 5; multiple carrier rollers 25 situated to face the switchback carrier path 24; and a cover body 26 for opening/closing the middle part of the switchback carrier path 24 toward the outside. The cover body 26 is supported swingingly near the bottom thereof by a supporting axis 27.

The movable body 72 is provided with a first guide unit 72*a* for guiding along the carrier path 5 the sheet fed from the lower feeding unit 3*a* located relatively far from the image forming unit 2; a second guide unit 72*b* for guiding along the carrier path 5 the sheet on which the image forming unit 2 has formed an image; a third guide unit 72*c* for guiding along the carrier path 5 the sheet carried from the switchback carrier path 24 to the carrier path 5 to form an image on both sides of the sheet.

The lock claw 21 is disposed on the movable body 72 near the transfer device 10. The lock claw 21 engages with the engagement portion 20 to prevent the movable body 72 from sliding open and disengages from the engagement portion 20 of the lock claw 21 is swung by operating a lever 21*a* connected to the lock claw 21.

The guide members 22 are inserted in guide holes (not shown) formed in the static body 71, so as to be slidable. Two of the guide members 22 are disposed on the respective sides of the carrier path 5 in terms of width thereof, and two of them are disposed respectively near the entrance and exit (the upper end and the lower end in FIG. 1) of the carrier path 5. The transfer device 10 is located among the guide members 22, more specifically near the central portion of the four guide members 22.

The transfer device 10 is mounted to the movable body 72 in such a manner that the movable body 72, when slid open, can accurately keep the position thereof relative to the image forming unit 2. The transfer device 10 is provided with a transfer belt 10*a* suspended by a pair of rolling wheels and a supporting body 10*b* supporting a contact terminal 10*c* which can be connected to a power source terminal 41 mounted to the static body 71. The supporting body 10*b* is mounted swingingly to the movable body 72. Further, positioning means 28 including positioning pins 28*a* and stoppers 28*b* is provided so as to accurately position the transfer device 10 relative to the image forming unit 2.

Referring to FIG. 2, the supporting body 10*b* is provided with: a pair of positioning pins 28*a*, having a pointed distal end like the vertex of a cone, which are disposed jutting between one of ends of the supporting body 10*b* which is located relatively near the feeding units 3 and the other end thereof which is located relatively near the discharge unit 4; and the two stoppers 28*b* which are disposed between those ends. The static body 71 is provided with positioning holes (not shown) shaped conically to match the positioning pins 28*a* and contact portions (not shown) which match the stoppers 28*b*. When the movable body 72 is slid closed, the positioning pins 28*a* enter the positioning holes to position the transfer device 10 in the retraction direction, whereas the stoppers 28*b* contact the contact portions to position the transfer device 10 relative to the surface of the image forming unit 2. At the same time, the contact terminal 10*c* connects to the power source terminal 41 so that voltage can be applied to the transfer device 10.

The control rollers 8 and the guide bodies 9 are mounted to the static body 71 so as to keep certain relative positions between the control rollers 8 and the guide bodies 9 even when the movable body 72 is slid open, contributing to improved resist precision. The guide bodies 9 are appropriately separated from the carrier path 5 between the control rollers 8 and the carrier rollers 13 located near the upper feeding unit 3, so as to precisely carry an end of the sheet carried from the feeding units 3 to the control rollers 8 and also to correct diagonal dislocation of moving sheet, for example.

Figure 4:
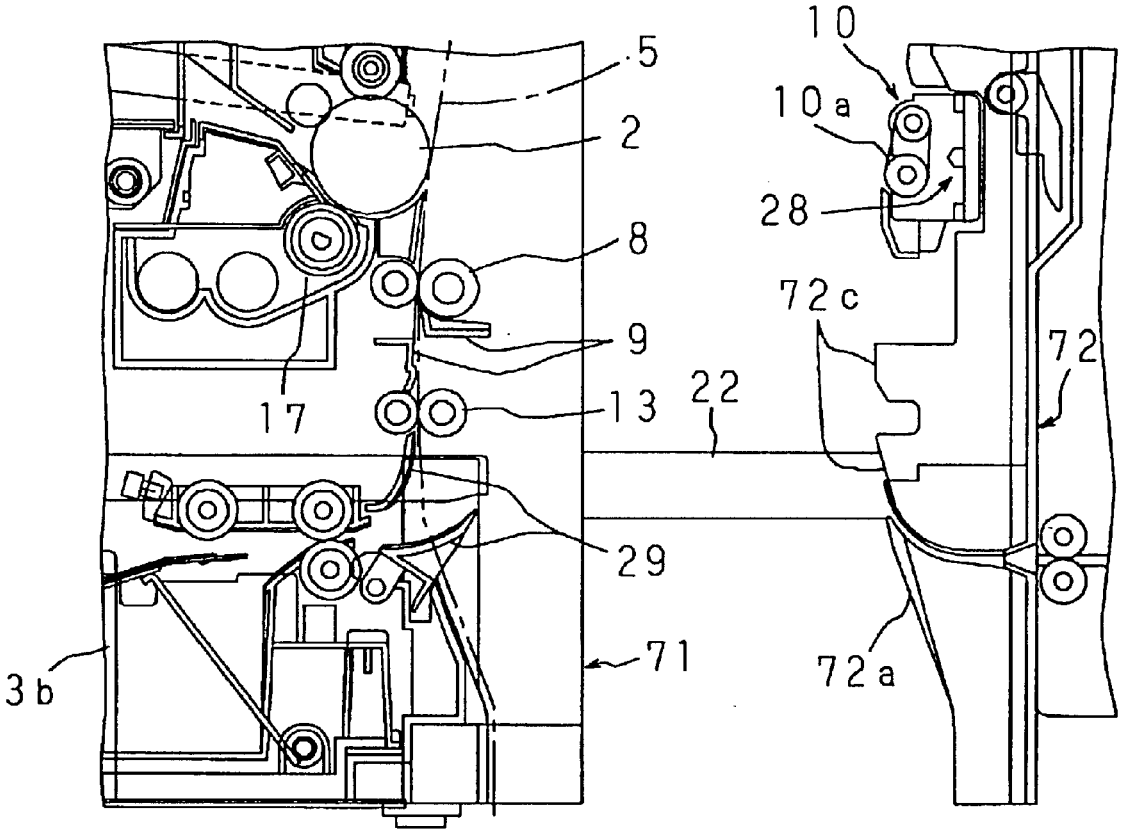
FIG. 4 is an enlarged cross-sectional view of the entrance and vicinity of a carrier path in an image forming apparatus in accordance with the invention.

FIG. 4 is an enlarged cross-sectional view of the entrance and vicinity of a carrier path in an image forming apparatus. The carrier path 5 of an upper feeding unit 3*b* located relatively near the image forming unit 2 is connected to the carrier path 5 by a pair of warped guide plates 29. One of the guide plates 29, at the sheet entrance or vicinity thereof, is engaged rotatably with the static body 71 and is adapted so that the carrier path 5 can be wide open by swinging those guide plates 29.

Figure 5A:
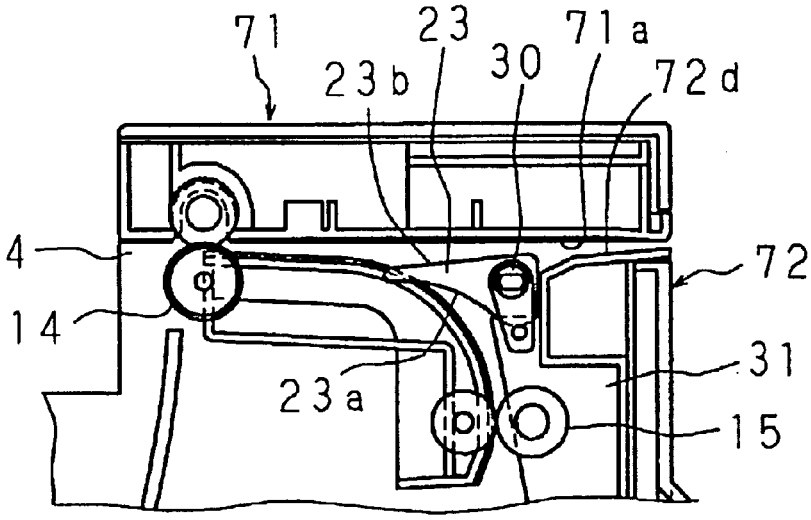
FIGS. 5A–5C are enlarged cross-sectional views of the exit and vicinity of a carrier path in an image forming apparatus in accordance with the invention.
Figure 5B:
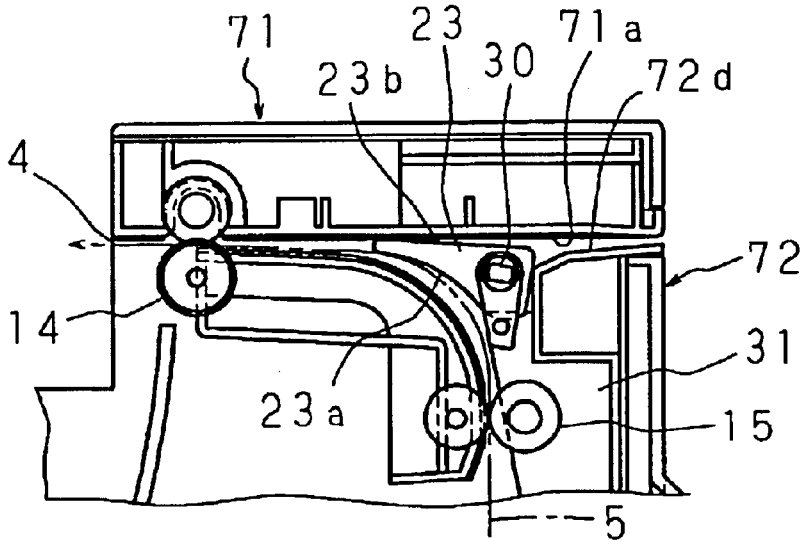
Figure 5C:
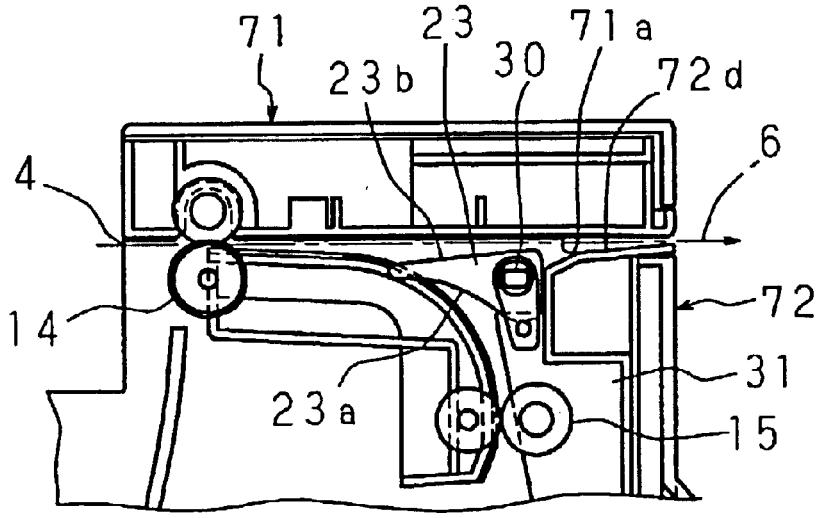

FIGS. 5A–5C are enlarged cross-sectional views of the exit and vicinity of the carrier path 5. The discharge unit 4 warps sideways near the exit of the carrier path 5, in other words, a part of the carrier path 5 located between the fixing device 11 and the discharge unit 4, so as to form a warped recess in which a fourth guide unit 72*d* is accommodated extending along the line linking the carrier switching body 23 to the sub-carrier path 6.

The sub-carrier path 6 is formed between the static body 71 and the movable body 72. A part of the sub-carrier path 6 from the entrance thereof to a suitable length away from the discharge unit 4 overlaps the carrier path 5. The sub-carrier path 6 extends flatly from the entrance to the exit thereof in a direction moving away from the discharge unit 4 and forms a connection portion to the carrier path 5 at a substantially T-shaped crossing.

Facing the sub-carrier path 6, are there located a guide unit 71*a* extending flatly sideways in a top part of the static body 71, as well as the carrier switching body 23 and the fourth guide unit 72*d* mounted to the movable body 72, so that when the movable body 72*a* is slid open, the sub-carrier path 6 can be wide open along the entire length thereof.

The sub-carrier path 6 is formed shorter than the carrier path 5 and so as to allow the movable body 72 to slide along the sub-carrier path 6.

The carrier switching body 23 is shaped substantially like a letter L having inside thereof a warped guide face 23*a* and outside thereof a flat guide face 23*b* facing the sub-carrier path 6. The carrier switching body 23 is supported at the middle part thereof by the holding body 31 so that the carrier switching body 23 can swing back and forth around a supporting axis 30 to connect the discharge unit 4 to the carrier path 5 and the sub-carrier path 6 (see FIG. 5A). To eject sheet to the discharge unit 4, the sheet carried from the fixing device 11 contacts the warped guide face 23*a*, causing the carrier switching body 23 to swing clockwise in FIG. 5A (see FIG. 5B). To carry sheet on which an image is printed entirely via a switchback, when the sheet completely passes the warped guide face 23*a* after contacting the warped guide face 23*a*, the carrier switching body 23 swings anti-clockwise in FIG. 5B due to the weight thereof (see FIG. 5C) and connects the discharge unit 4 to the carrier path 5 and sub-carrier path 6. In this situation, the sheet can be carried from the discharge unit 4 to the sub-carrier path 6 by activating the carrier rollers 14 and thereby reversing the direction of the movement of the sheet.

The carrier switching body 23 is supported swingingly by the holding body 31 which is in turn attached swingingly to the movable body 72. Positioning means 32 including positioning pins 32*a* and stoppers 32*b* is adapted so as to accurately keep the position of the carrier switching body 23 relative to the carrier path 5 and the sub-carrier path 6.

Referring to FIG. 2, the holding body 31 is provided with a pair of positioning pins 32*a*, having a pointed distal end like the vertex of a cone, which are disposed jutting between one of ends of the holding body 31 which is located relatively near the feeding units 3 and the other end thereof which is located relatively near the discharge unit 4; and the two stoppers 32*b* which are disposed between those ends. The static body 71 is provided with positioning holes (not shown) shaped conically to match the positioning pins 32*a* and contact portions (not shown) which match the stoppers 32*b*. When the movable body 72 is slid closed, the positioning pins 32*a* enter the positioning holes to position the carrier switching body 23 in the retracting direction, whereas the stoppers 32*b* contact the contact portions to position the carrier switching body 23 relative to the carrier path 5 and the sub-carrier path 6.

Suppose that moving sheet is stuck in the carrier path 5 as a result of a problem in the image forming apparatus. With the slide prevention of the movable body 72 disabled, the movable body 72 is slid parallel to the static body 71 to open. Accordingly, the transfer device 10 and the carrier switching body 23 move away together with the movable body 72, and the carrier path 5 is widely opened with a substantially equal distance along its entire length. In whichever part of the carrier path 5*a* sheet is stuck, the sheet can be quickly spotted and readily reached by hand for removal. The image forming apparatus thus delivers good operability in sheet removal.

The sub-carrier path 6 extends flatly in a direction away from the discharge unit 4 and sits between the static body 71 and the movable body 72; therefore, the sub-carrier path 6 can be wide open along the substantially entire length thereof by sliding and thus opening the movable body 72 sideways. Accordingly, sheet stuck in the sub-carrier path 6 in, for example, a double-side copying operation can be readily spotted and easily removed. The image forming apparatus thus again delivers good operability in sheet removal.

Additionally, since the sub-carrier path 6 is shorter than the carrier path 5 and the movable body 72 is sidable along the sub-carrier path 6, the carrier path 5 and the sub-carrier path 6 can be wide open along the entire lengths thereof by sliding the movable body 72*a* relatively small distance.

Guided by the guide members 22, the movable body 72 slides flatly and now experiences only a relatively small impact when slid open. The movable body 72 no longer needs a complicated supporting mechanism. The image forming apparatus weighs less and requires less installation space.

The carrier rollers 12–15 are mounted to the static body 71 and provided in pairs to carry sheet while holding the sheet in between. Therefore, opening the carrier path 5, which extends upright as mentioned above, allows the rollers to continue holding the sheet stuck in the carrier path 5 in between. Those areas surrounding the carrier path 5 and the user's hands can be thereby prevented from being smeared with an unfixed toner image on sheet which droops or falls from the upright carrier path 5. The sheet stuck in the carrier path 5 can be readily spotted. The image forming apparatus thus again delivers good operability in sheet removal.

As detailed in the foregoing, when the movable body 72 slides open, the transfer device 10 in the movable body 72 moves away from the image forming unit 2 in the static body 71. Therefore, if sheet gets stuck in the carrier path 5, the sheet remaining held between the image forming unit 2 and the transfer device 10 is released from the tight hold. Thus, the surfaces of the image forming unit 2 and the transfer belt of the transfer device 10 not in operation are now prevented from being damaged by the sheet held between the image forming unit 2 and the transfer device 10 as a result of, for example, pulling the stuck sheet with excessive force in an attempt to remove the sheet. The advantage is especially evident with printers or the like which are often required to handle overhead projection sheets, postcards, envelopes, etc. made of either hard or thick sheet: the invention provides protection to the surface of the image forming unit 2 against scratches with these sheet materials.

After removing the stuck sheet, the carrier path 5 can be closed by slide-closing the movable body 72. Since the movable body 72 is slid flatly by means of the four guide members 22 disposed on the respective sides of the carrier path 5 in terms of width thereof and near the entrance and exit of the carrier path 5, the transfer device 10 can be moved toward the image forming unit 2 so as to be positioned substantially correctly with respect to the image forming unit 2, even if the movable body 72 is slid closed while the movable body 72 is being lifted by the handle and displaced accordingly out of correct position. As a result, good positional relationship can be maintained among components of the carrier path 5 between the static body 71 and the movable body 72: for example, between the image forming unit 2 and the transfer device 10 and between the carrier switching body 23 and the carrier path 5 and the sub-carrier path 6. Consequently, problems are less likely to occur to the moving sheet in the carrier path 5.

The supporting body 10*b* supporting the transfer device 10 and the holding body 31 supporting the carrier switching body 23 are attached swingingly to the movable body 72. When the movable body 72 is slid closed, the transfer device 10 can be positioned accurately with respect to the surface of the image forming unit 2, and the carrier switching body 23 can be positioned accurately with respect to the carrier path 5 and the sub-carrier path 6. This improves the quality of the image formed on the sheet. The sheet can be carried in a satisfactory manner in the sub-carrier path 6 in which sheet passes after the fixing and conventionally tends to be carried only in an unstable manner.

The carrier switching body 23 is adapted to swing due to the weight thereof and sheet-carrying force, without using a driver. The carrier switching body 23 can be mounted to the movable body 72, which enables the sub-carrier path 6 to be opened in a satisfactory manner when the movable body 72 is slid open.

Embodiment 2

Figure 6:
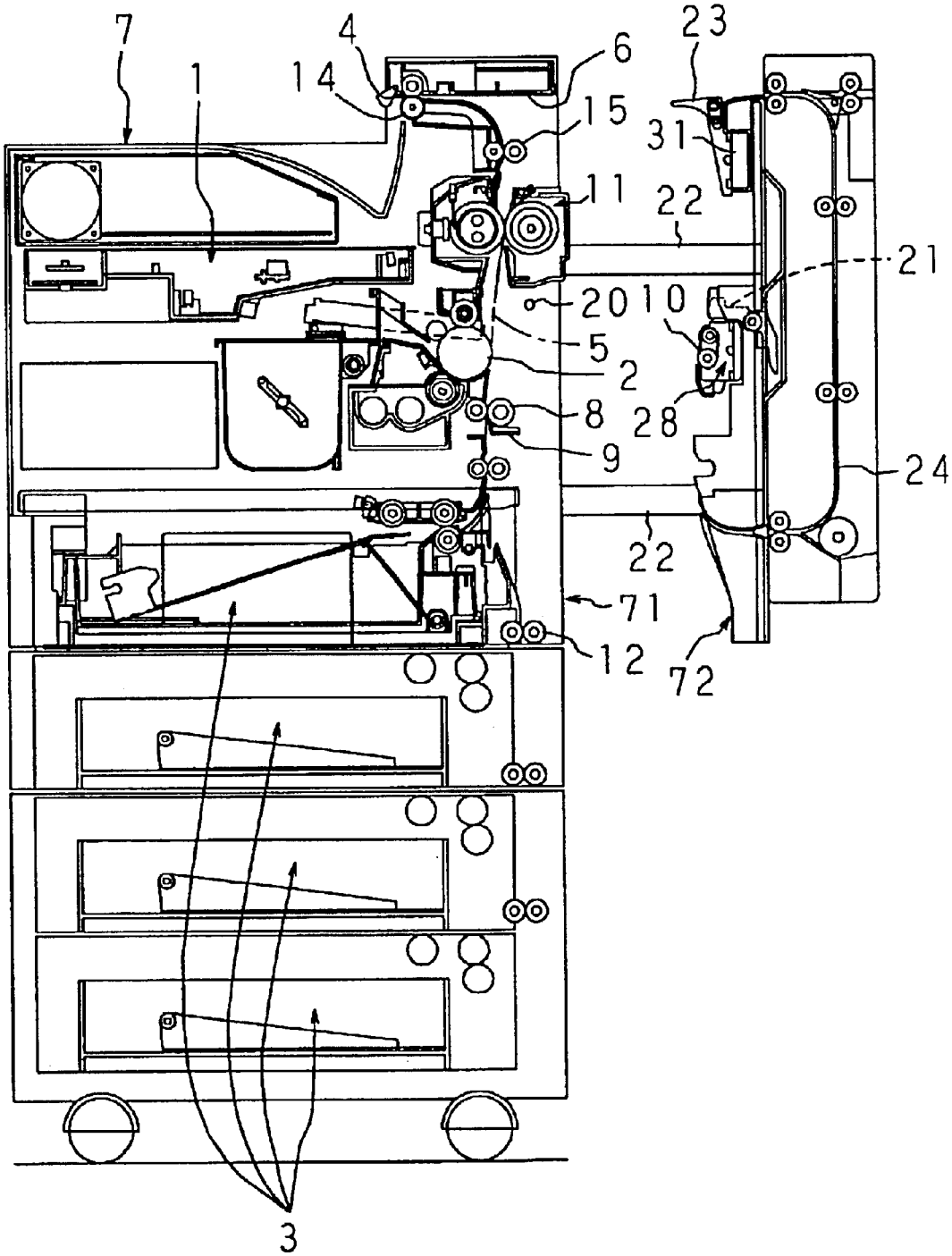
FIG. 6 is a cross-sectional view of a second embodiment of the image forming apparatus in accordance with the invention, showing an open carrier path.

FIG. 6 is a cross-sectional view of an open carrier path of the second embodiment. An image forming apparatus of the second embodiment is structured so that multiple feeding units 3 can be optionally stacked in a lower part of the static body 71. In FIG. 6, two feeding units are optionally mounted to the image forming apparatus of the first embodiment, and each feeding unit 3 is connected to the carrier path 5. Otherwise, the second embodiment is similar to the first embodiment in configuration and effects; similar members are given the same reference numerals, and detailed description is omitted about the similar members and also about effects of those members.

Embodiment 3

An image forming apparatus of the third embodiment is provided with guide members 22 only near the entrance and exit of the carrier path 5. Specifically, the guide members 22 are located at substantially the same places as those shown in FIG. 2, in a side view.

In the third embodiment, the guide members 22 can be disposed above and below the main body 7 having an upright carrier path 5; therefore, sheet stuck in the carrier path 5 can be readily removed, with none of the guide members 22 obstructing the removing action. Further, the movable body 72 can be slid smoothly and with less deformation in the slide movement; as a result, the movable body 72 can be slid straightly. Otherwise, the third embodiment is similar to the first embodiment in configuration and effects; similar members are given the same reference numerals, and detailed description is omitted about the similar members and also about effects of those members.

Embodiment 4

Figure 7:
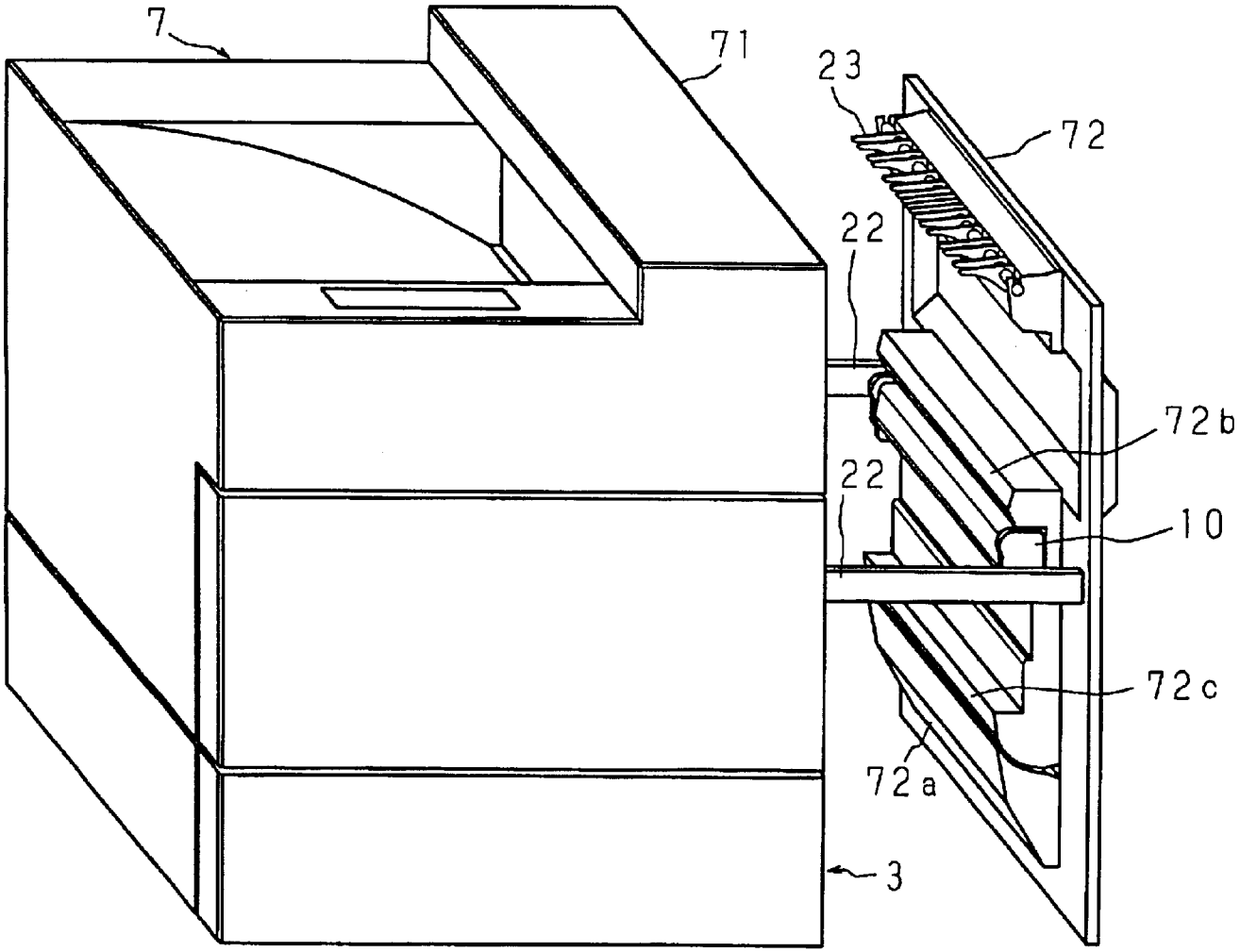
FIG. 7 is a perspective view of a fourth embodiment of the image forming apparatus in accordance with the invention, showing an open carrier path.

FIG. 7 is a perspective view of an open carrier path of the fourth embodiment. In an image forming apparatus of the fourth embodiment, the guide members 22 are disposed on the respective sides of the carrier path 5 in terms of width thereof, and the transfer device 10 is disposed near the two guide members 22.

In the fourth embodiment, the transfer device 10 is located between the two guide members 22 disposed on the respective sides of the upright carrier path 5 in terms of width thereof, therefore, when the movable body 72 is slid closed, the transfer device 10 can be moved straightly toward the image forming unit 2 while keeping a substantially accurate positional relationship, and as a result can be positioned accurately with respect to the image forming unit 2, which ultimately improves the quality of the image formed on the sheet. Otherwise, the fourth embodiment is similar to the first embodiment in configuration and effects; similar members are given the same reference numerals, and detailed description is omitted about the similar members and also about effects of those members.

Embodiment 5

Figure 8:
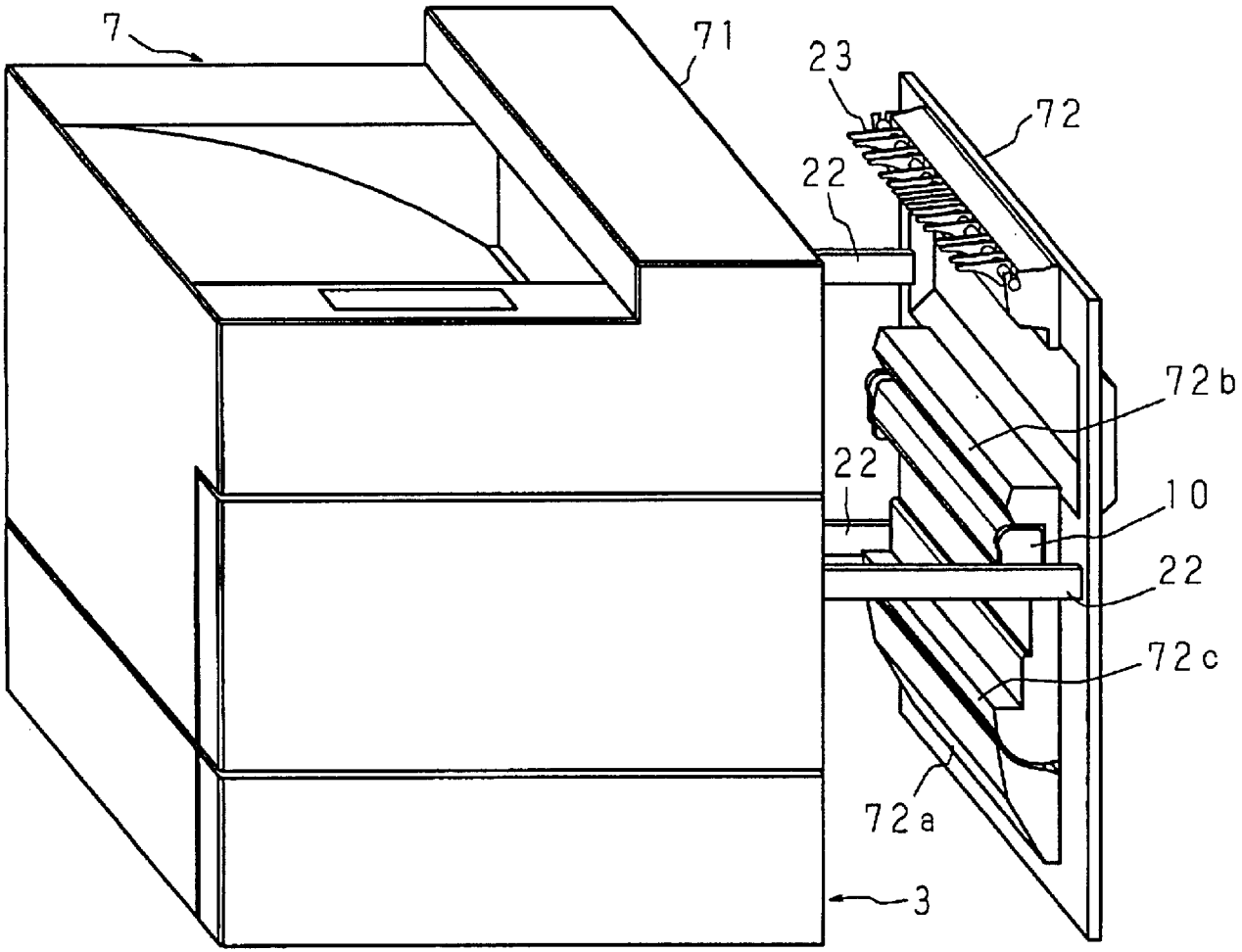
FIG. 8 is a perspective view of a fifth embodiment of the image forming apparatus in accordance with the invention, showing an open carrier path.

FIG. 8 is a perspective view of an open carrier path of the fifth embodiment. In an image forming apparatus of the fifth embodiment are there provided more guide members 22 on one side of the carrier path 5 in terms of width thereof than on the other side of the carrier path 5, or more specifically, in the back than in the front of the installed image forming apparatus.

In the fifth embodiment, the image forming apparatus includes less guide members 22 in the front than in the back as viewed when the image forming apparatus is installed in a suitable place, which makes it easier to spot sheet stuck in the carrier path 5. Moreover, the guide members 22 present less obstruction to the sheet removing action. The image forming apparatus thus delivers good operability in sheet removal. Otherwise, the fifth embodiment is similar to the first embodiment in configuration and effects; similar members are given the same reference numerals, and detailed description is omitted about the similar members and also about effects of those members.

Embodiment 6

Figure 9:
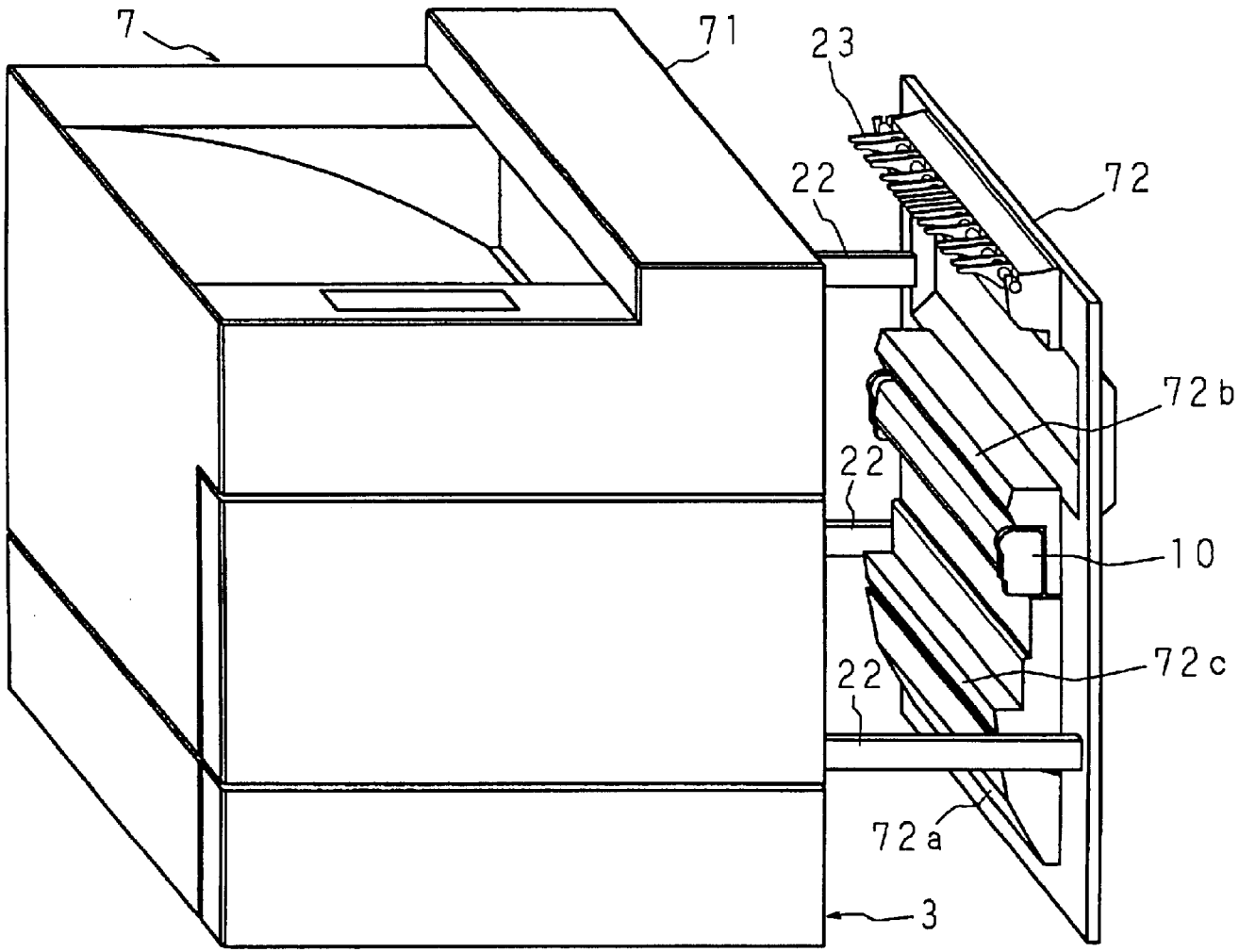
FIG. 9 is a perspective view of a sixth embodiment of the image forming apparatus in accordance with the invention, showing an open carrier path.
Figure 10:
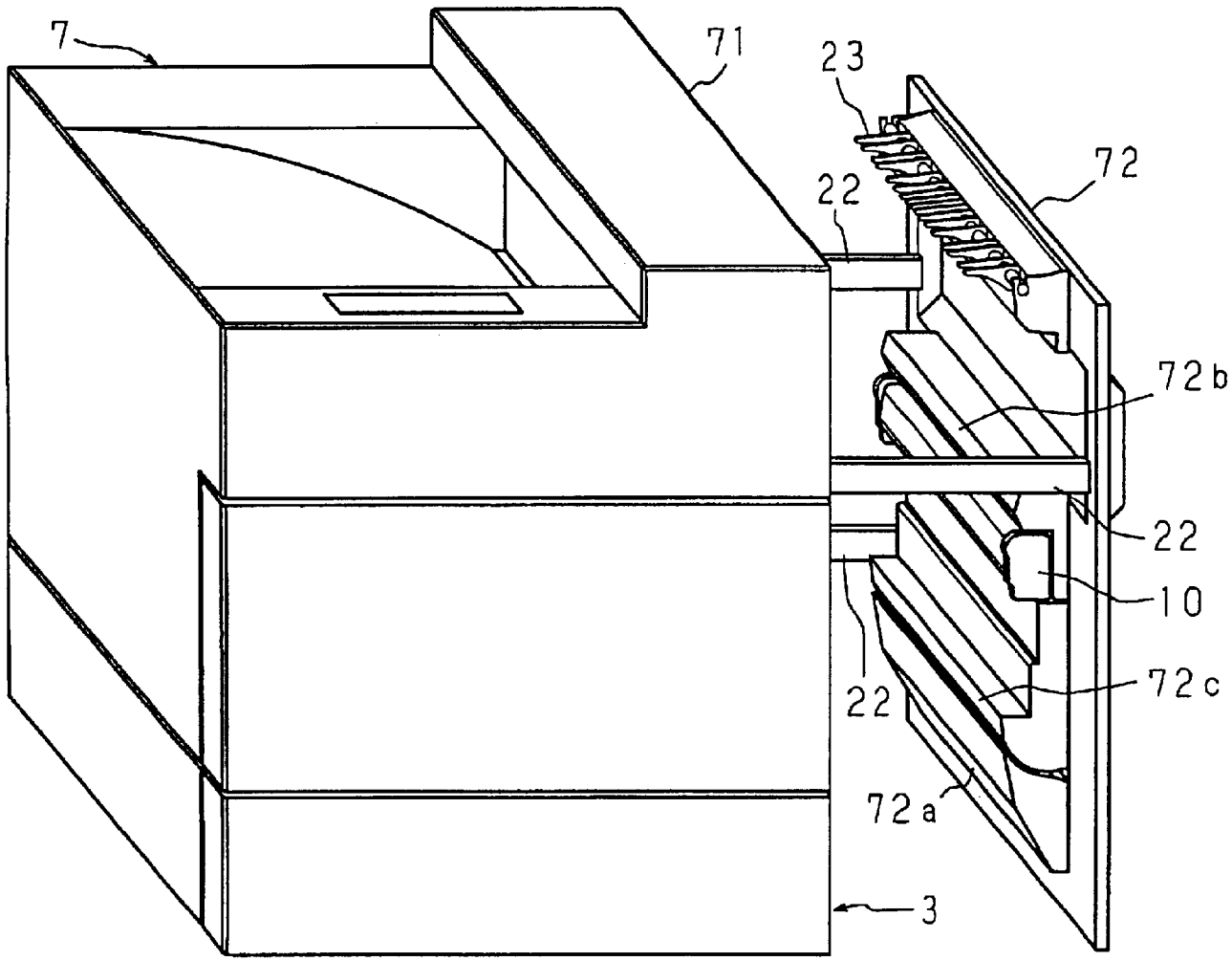
FIG. 10 is a perspective view of the sixth embodiment of the image forming apparatus in accordance with the invention, showing an open carrier path.

FIGS. 9 and 10 are perspective views of an open carrier path of the sixth embodiment. In an image forming apparatus of the sixth embodiment, the guide member 22 located in the front of the image forming apparatus as viewed with the image forming apparatus installed in a suitable place is disposed away from parts of the carrier path 5 where sheet is likely to get stuck. Those parts include a winding part where the carrier switching body 23 is provided, a connection portion where the sub-carrier path 6 is connected to the carrier path 5, and another connection portion where the switchback carrier path 24 is connected to the carrier path 5.

In FIG. 9, that guide member 22 is disposed near the entrance of the carrier path 5, a distance away from the winding part where the carrier switching body 23 is provided and also from the connection portion where the sub-carrier path 6 is connected to the carrier path 5. In FIG. 10, that guide member 22 is disposed beside the transfer device 10 and the fixing device 11, a distance away from the winding part where the carrier switching body 23 is provided, from the connection portion where the sub-carrier path 6 is connected to the carrier path 5, and also from the connection portion where the switchback carrier path 24 is connected to the carrier path 5.

In the sixth embodiment, the guide member 22 is disposed away from those parts of the carrier path 5 where problems are likely to occur with moving sheet. The guide member 22 therefore presents less obstruction in removing sheet stuck in the carrier path 5. The image forming apparatus thus delivers good operability in sheet removal. Otherwise, the sixth embodiment is similar to the first embodiment in configuration and effects; similar members are given the same reference numerals, and detailed description is omitted about the similar members and also about effects of those members.

Embodiment 7

Figure 11:
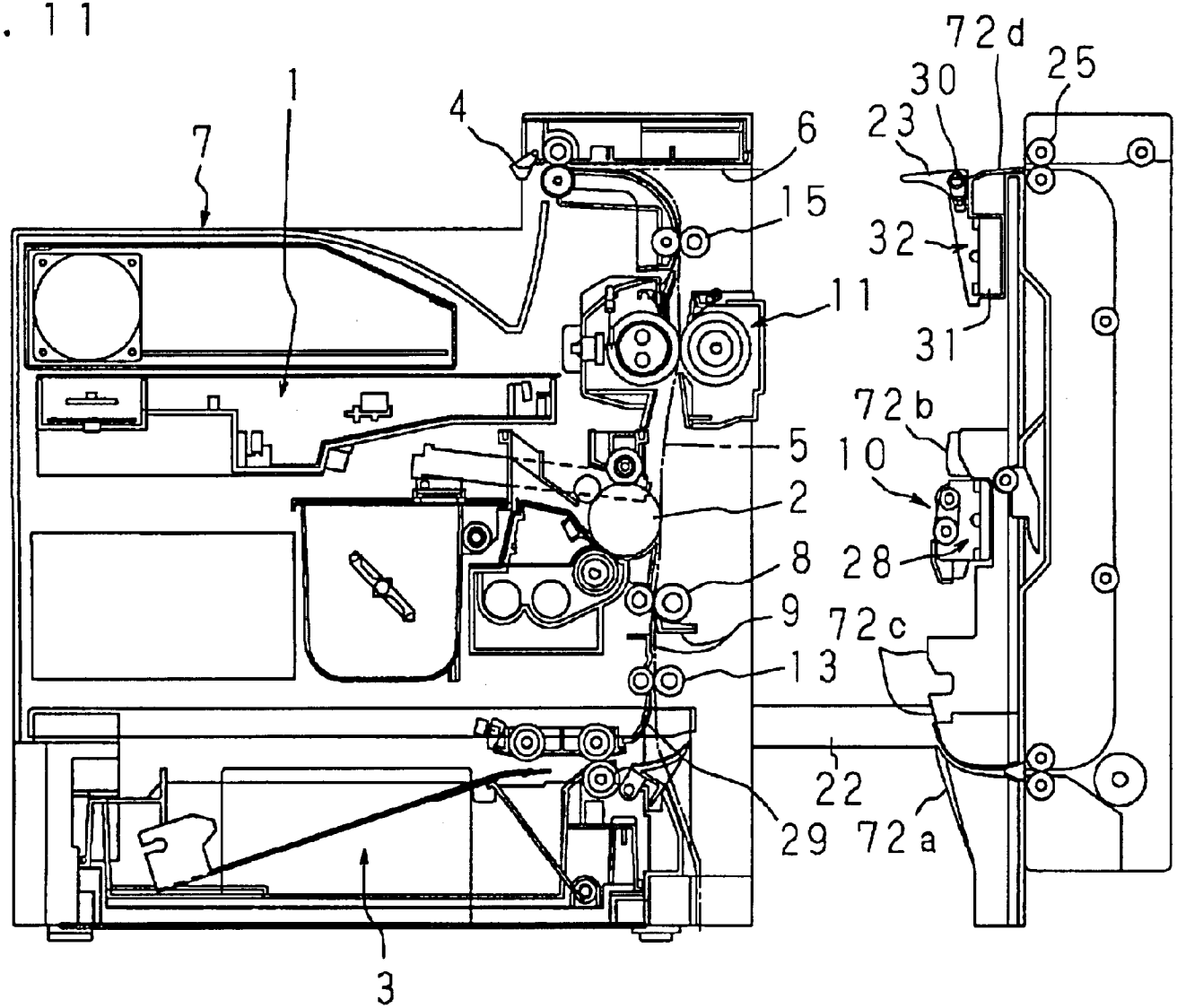
FIG. 11 is a cross-sectional view of major components of an image forming apparatus in accordance with the invention, showing an open carrier path.

FIG. 11 is a cross-sectional view of major components of an image forming apparatus, showing an open carrier path. In an image forming apparatus of the seventh embodiment, the aforementioned guide member 22 is disposed only near the entrance of the carrier path 5.

In the seventh embodiment, the guide member 22 is disposed a distance away from parts of the carrier path 5 where sheet is likely to get stuck. Those parts include a winding part where the carrier switching body 23 is provided, a connection portion where the sub-carrier path 6 is connected to the carrier path 5, and another connection portion where the switchback carrier path 24 is connected to the carrier path 5. The guide member 22 therefore presents even less obstruction in removing sheet stuck in the carrier path 5. The image forming apparatus thus delivers improved operability in sheet removal. Otherwise, the seventh embodiment is similar to the first embodiment in configuration and effects; similar members are given the same reference numerals, and detailed description is omitted about the similar members and also about effects of those members.

As in the embodiments detailed in the foregoing, the transfer device 10 and the prevention means (lock claw 21) are disposed close to each other, among multiple guide members 22. The configuration enables accurate positioning of the transfer device 10 with respect to the image forming unit 2 and prevents the transfer device 10 from being displaced with respect to a transfer area on the image forming unit 2, which improves the quality of the image formed on sheet.

Throughout the foregoing embodiments, the transfer device 10 has been disposed among the plurality of guide members 22. Alternatively, the transfer device 10 may be disposed between the prevention means and those guide members 22. Further, the transfer device 10 may be disposed at the central portion among the guide members 22 or near the prevention means. The transfer device 10, as shown in FIG. 8, may be disposed with one of ends thereof located between the two guide members 22 in the back and the other end thereof located near the guide member 22 in the front.

Throughout the foregoing embodiments, the guide members 22 have been mounted to the movable body 72, and the guide holes for guiding the sliding movement of the guide members 22 have been formed in the static body 71. A converse configuration is also possible in which the guide members 22 are mounted to the static body 71 and the guide holes are formed in the movable body 72. The guide members 22 may be structured based on a pair of tubes which are engaged with each other so as to move relative to each other, with one of the tubes fixed to the static body 71 and the other tube fixed to the movable body 72. There are no limitations on the number of guide members 22.

Throughout the foregoing embodiments, the static body 71 of the main body 7 has been provided with the pair of control rollers 8, the pair of guide bodies 9, and the carrier rollers 12, 13, 15, whereas the movable body 72 has been provided with the transfer device 10 and the carrier switching body 23. Alternatively, the movable body 72 may be provided with any or all of the control rollers 8, the guide bodies 9, and the carrier rollers 12, 13, 15, whereas the static body 71 may be provided with either or both of the transfer device 10 and the carrier switching body 23.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus, comprising:

an image forming unit for forming an image on a sheet; and a main body having a first body and a second body which are separable from each other; wherein the first body is provided with the image forming unit and the second body is slidable with respect to the first body while maintaining the posture thereof, and the second body comprises a carrier path for carrying a sheet carried from the image forming unit back to the image forming unit, and the second body comprises a cover body for opening and closing the carrier path with respect to the outside, the cover body being allowed to swing via a supporting axis.

* * * * *